US011841210B2

(12) United States Patent
Sun et al.

(10) Patent No.: US 11,841,210 B2
(45) Date of Patent: Dec. 12, 2023

(54) OPEN AIRBORNE OR VEHICLE-MOUNTED SIGHT

(71) Applicant: Huanic Corporation, Shaanxi (CN)

(72) Inventors: Jianhua Sun, Shaaxi (CN); Xuewen Cheng, Shaanxi (CN)

(73) Assignee: Huanic Corporation, Xi'an (CN)

( * ) Notice: Subject to any disclaimer, the term of this patent is extended or adjusted under 35 U.S.C. 154(b) by 102 days.

(21) Appl. No.: 17/613,032

(22) PCT Filed: Dec. 31, 2019

(86) PCT No.: PCT/CN2019/130413
§ 371 (c)(1),
(2) Date: Nov. 19, 2021

(87) PCT Pub. No.: WO2020/244218
PCT Pub. Date: Dec. 10, 2020

(65) Prior Publication Data

US 2022/0244015 A1 Aug. 4, 2022

(30) Foreign Application Priority Data

Jun. 4, 2019 (CN) ..... 201920835295.2

(51) Int. Cl.
*F41G 1/30* (2006.01)
*F41G 1/16* (2006.01)
*F41G 1/46* (2006.01)

(52) U.S. Cl.
CPC ..... *F41G 1/30* (2013.01); *F41G 1/16* (2013.01); *F41G 1/46* (2013.01)

(58) Field of Classification Search
CPC ..... F41G 1/30; F41G 1/16; F41G 1/46
USPC ..... 42/113
See application file for complete search history.

(56) References Cited

U.S. PATENT DOCUMENTS

| | | | | |
|---|---|---|---|---|
| 7,647,720 | B1 | 1/2010 | Vendetti | |
| 11,555,669 | B2 * | 1/2023 | Pischke | F41G 1/35 |
| 2002/0078618 | A1 | 6/2002 | Gaber | |
| 2010/0083554 | A1 | 4/2010 | Elpedes et al. | |

(Continued)

FOREIGN PATENT DOCUMENTS

| | | | |
|---|---|---|---|
| CN | 200989749 | Y | 12/2007 |
| CN | 102472604 | A | 5/2012 |

(Continued)

OTHER PUBLICATIONS

Japanese Office Action dated Nov. 22, 2022, in connection with Japanese Application No. 2021-570228.

(Continued)

*Primary Examiner* — Samir Abdosh
(74) *Attorney, Agent, or Firm* — Wolf, Greenfield & Sacks, P.C.

(57) ABSTRACT

An open airborne or vehicle-mounted sight, including a carrier and an inner red dot module carrier installed on the carrier. The inner red dot module carrier is installed on the top surface of the carrier by means of a pitch angle adjustment mechanism. An inner red dot module, including an LED light source capable of projecting graphic signs; the LED light source includes a point light source, a peripheral light source surrounding the point light source, and the peripheral light source is a discontinuous line light source.

14 Claims, 9 Drawing Sheets

(56) References Cited

U.S. PATENT DOCUMENTS

| | | | | |
|---|---|---|---|---|
| 2011/0154713 | A1 | 6/2011 | Jung et al. | |
| 2013/0008072 | A1* | 1/2013 | Chung | F41G 1/30 42/113 |
| 2015/0198421 | A1* | 7/2015 | Crispin | F41G 11/006 42/126 |
| 2017/0038177 | A1 | 2/2017 | Sun | |

FOREIGN PATENT DOCUMENTS

| | | | |
|---|---|---|---|
| CN | 107782199 | A | 3/2018 |
| CN | 207456288 | U | 6/2018 |
| CN | 109186346 | A | 1/2019 |
| JP | 2017-503145 | A | 1/2017 |
| JP | 2018-159546 | A | 10/2018 |
| WO | WO 2008/140830 | A2 | 11/2008 |

OTHER PUBLICATIONS

Extended European Search Report dated Jun. 24, 2022, in connection with European Application No. 19932062.3.
International Search Report dated Mar. 19, 2020 in connection with International Application No. PCT/CN2019/130413.

* cited by examiner

OPEN AIRBORNE OR VEHICLE-MOUNTED SIGHT

CROSS REFERENCE

The present application is based on the International Application No. PCT/CN2019/130413, filed on Dec. 31, 2019, which is based upon and claims priority to Chinese Patent Application No. 201920835295.2, filed on Jun. 4, 2019, and the entire contents thereof are incorporated herein by reference.

TECHNICAL FIELD

The present disclosure relates to an open airborne or vehicle-mounted sight.

BACKGROUND

The existing vehicle-mounted or airborne sights have requirements for large volume and wide aiming angles. At the same time, there are corresponding requirements for different shooting distances and corresponding ballistics. It is necessary to adjust the shooting angle of the inner red dot aiming point. The part of the red dot module carrier of the existing large-scale open sight is exposed above the bracket and is not protected as necessary. After a collision, the structure will be more or less damaged, thereby affecting the aiming accuracy. At the same time, the traditional sighting telescope of the light source part adopts the method of adding a light barrier in front of the surface light source to obtain the projected reticle, which brings great power consumption.

SUMMARY

In one aspect of the present disclosure, an open airborne or vehicle-mounted sight is provided, including: a carrier and an inner red dot module carrier installed on the carrier;

the inner red dot module carrier is installed on a top surface of the carrier through a pitch angle adjustment mechanism; an inner red dot module, comprising an LED light source capable of projecting graphic signs;

the LED light source comprising a point light source, a peripheral light source surrounding the point light source, and the peripheral light source is a discontinuous line light source.

In an exemplary embodiment of the present disclosure, the pitch angle adjustment mechanism includes a front supporting assembly, a fulcrum member and a rear angle adjustment assembly;

the front supporting assembly includes at least a return spring to cooperate with the rear angle adjustment assembly to use the fulcrum member as a pivot point to realize an angle adjustment of the inner red dot module carrier;

the fulcrum member is a shaft that being passed transversely through a shaft hole on the inner red dot module carrier, two ends of the shaft respectively being penetrated left and right side walls of the carrier;

the rear angle adjustment assembly at least comprises an angle adjustment cam and an adjustment operating lever;

the angle adjustment cam is installed in a cam mounting cavity at a rear end of a top surface of the carrier;

a cam mounting end of the adjustment operating lever is inserted into the cam mounting cavity from an outside of a longitudinal side wall of the cam mounting cavity inward and then is inserted into a mounting shaft hole of the angle adjustment cam; a positioning knock pin is inserted into a cam limiting hole formed on a circumferential wall of the angle adjustment cam and then is configured to extend into a limiting hole formed on a circumferential wall of the cam mounting end to realize a fixing of the angle adjustment cam.

In an exemplary embodiment of the present disclosure, an end of the adjustment operating lever placed outside the cam mounting cavity is an operating end, an end portion of the operating end is provided with at least a pair of opposite planes; and a circumferential side wall of the operating end is provided with a pair of shoulders at the innermost end of the opposite planes;

a positioning ring with an inner hole that matches an end portion of the operating end is sleeved on the end portion of the operating end and an inner side of the positioning ring abuts on the shoulders;

a handwheel retaining ring is threadedly connected to an outer end portion of the positioning ring to achieve a fixed limit on the positioning ring;

an tubular adjustment handwheel is sleeved on the operating end, the positioning ring and the hand wheel retaining ring, and an inner side of a cavity of the tubular adjustment handwheel is provided with a same cross-section as the positioning ring, so as to be locked on the opposite planes;

a plurality of positioning pins arranged in a circumferential direction are arranged on an end surface of an inner end of the tubular adjustment handwheel to cooperate with a plurality of positioning pin limiting hole circumferentially arranged on an outer wall of the cam mounting cavity to realize a circumferential limit of the tubular adjustment handwheel;

a cross section of an outside of cavity of the tubular adjustment handwheel is circular, and a handwheel spiral spring is placed in a circular cavity described above and sleeved on an end portion of the operating end;

a hollow cylindrical portion of a handwheel limiting sleeve is inserted into an inner hole of the handwheel spiral spring, and a ring flange of the handwheel limiting sleeve is configured to touch an outer diameter edge of the handwheel spial spring, and a diameter of the ring flange is larger than an inner diameter outside the cavity of the tubular adjustment handwheel;

a handwheel connecting screw is threadedly connected to a screw hole on an end surface of an end portion of the operating end after passing through the hollow cylinder.

In an exemplary embodiment of the present disclosure, a limiting pin extending axially along the angle adjustment cam is arranged between the angle adjustment cam and the cam mounting end to limit a rotation angle range of the angle adjustment cam.

In an exemplary embodiment of the present disclosure, the rear angle adjustment assembly further includes a limiting assembly member which is provided with a threaded pipe section and an extended arc portion disposed on an outer side wall of an end portion of the threaded pipe section, and the positioning pin limiting hole is opened on the extended arc portion.

In an exemplary embodiment of the present disclosure, a limiting knob is provided on an outer ring of the limiting assembly member for insertion in a circumferential limiting groove on a bottom surface of the positioning ring, so as to limit the rotation angle of the positioning ring.

In an exemplary embodiment of the present disclosure, the front supporting assembly further includes a mounting hole opened at a front end of a top surface of the carrier and a front cover plate detachably connected to the mounting hole;

there are two return springs, and lower ends of the two return springs are inserted side by side into two guiding and limiting canisters arranged on a top surface of the front cover plate and higher than the top surface of the carrier.

In an exemplary embodiment of the present disclosure, a bottom surface of the inner red dot module carrier is provided with mounting blind holes, a battery compartment matching arc surface and a cam arc cavity from a front to a back and respectively cooperate with the front supporting assembly, a battery compartment, and the cam mounting cavity;

the front supporting assembly further includes a mounting hole opened at a front end of the top surface of the carrier and a front cover plate detachably connected to the mounting hole;

there are two return springs, and lower ends of the two return springs are inserted side by side into two guiding and limiting canisters arranged on a top surface of the front cover plate and higher than the top surface of the carrier;

an upper end of a drit-proof boot is screwed to the mounting blind hole of the front supporting assembly, and a lower end of the drit-proof boot is connected to a front fixing ring, the front fixing ring is detachably connected with the front cover plate;

the return spring and a guiding and limiting canister are all sleeved in the drit-proof boot, and the return spring abuts on a top wall of the mounting blind hole of the front supporting assembly.

In an exemplary embodiment of the present disclosure, a tail end of the inner red dot module carrier is provided with an inner red dot module, a front end of the inner red dot module carrier is mounted with a lens through a lens mounting frame;

a top surface of the inner red dot module carrier is provided with a solar electric panel assembly, and at a front and back of the solar electric panel assembly, a plurality of lateral fillets are engraved on the top surface of the inner red dot module carrier to eliminate the adverse effects of ambient stray light;

a rear end of the top surface of the carrier is provided with an inner red dot module mounting cavity placed on a rear side of the cam mounting cavity.

In an exemplary embodiment of the present disclosure, a tail end of the cam mounting end is a constriction for engaging in a limiting groove on a corresponding side of the cam mounting cavity, and is fixed in the limiting groove through screws screwing an arc positioning sleeve with ear holes on both sides; a magnifier is provided on a side of a tail end of the carrier.

The advantages of the present disclosure are: the firing table can be adjusted accurately and conveniently, the adjustment of the trajectory can be completed, the operation is simple, and the rapid shooting is not affected.

The present disclosure will be described in detail below with reference to the accompanying drawings and embodiments.

DETAILED DESCRIPTION

Figure 1:
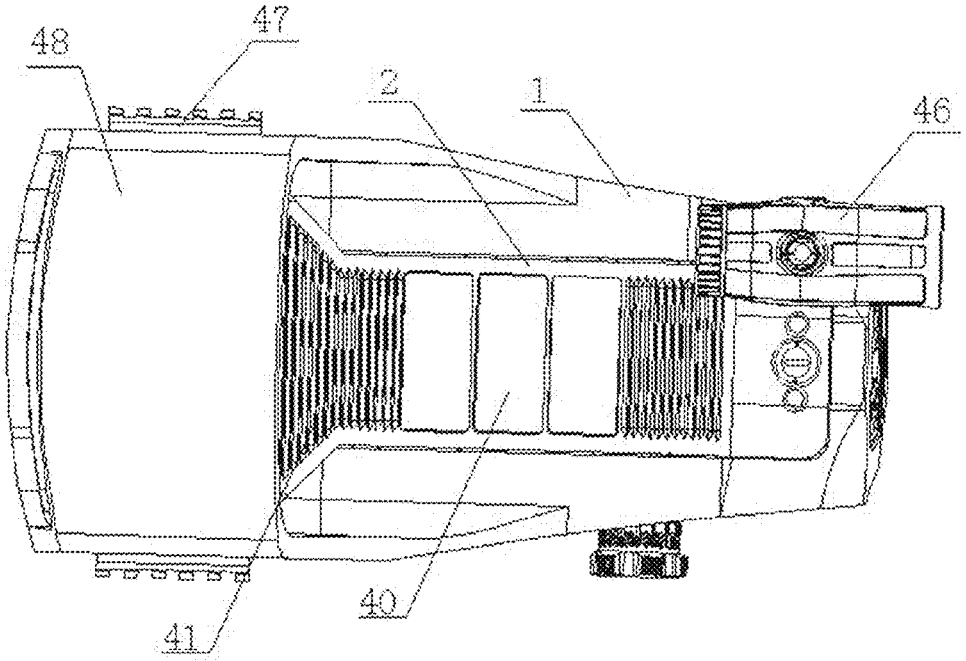
FIG. 1 is a top view of an open airborne or vehicle-mounted sight.
Figure 2:
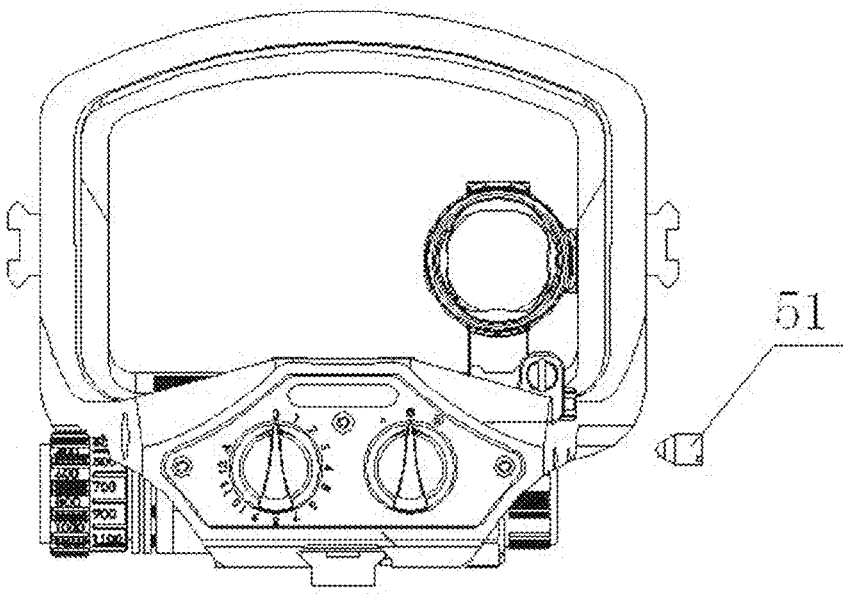
FIG. 2 is a rear view of an open airborne or vehicle-mounted sight.
Figure 3:
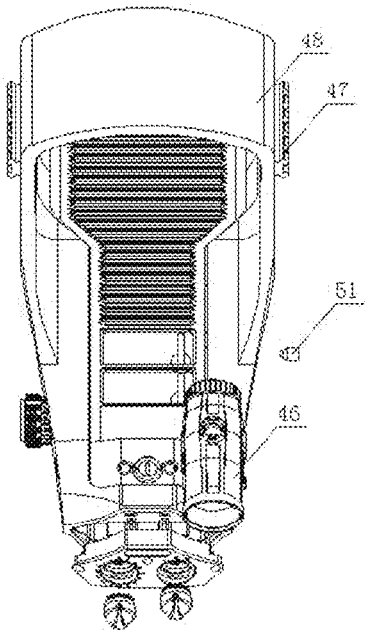
FIG. 3 is a rear-oblique bird's-eye view of an open airborne or vehicle-mounted sight.

In order to facilitate and more accurately adjust the shooting angle or direction of the inner red dot sight, this embodiment provides an open airborne or vehicle-mounted sight as shown in FIGS. 1 to 3, including a carrier 1 (or may be called the installation main body) and an inner red dot module carrier 2 installed on the carrier 1, the inner red dot module carrier 2 is installed on the top surface of the carrier 1 through a pitch angle adjustment mechanism. In this way, the angle of the inner red dot module carrier 2 can be adjusted to adjust the shooting direction of the inner red dot sight to complete the adjustment of the shooting table, that is, the adjustment of the trajectory. The inner red dot module includes an LED light source capable of projecting graphic signs; the LED light source includes a point light source, a peripheral light source surrounding the point light source, and the peripheral light source is a discontinuous line light source. In this way, specific reticle patterns can be projected, which overcomes the defects in the related art that the projected reticle is obtained by adding an aperture in front of the surface light source, which results in a complex structure and high power consumption.

It can be clearly seen from FIG. 1 or FIG. 2 that a magnifier 46 is provided on a side of the rear end of the carrier 1, that is, the upper right end shown in FIG. 1 or the right side of the rear end shown in FIG. 2, to assist in aiming. A support frame 48 is disposed on the front end of the carrier 1, that is, the left end shown in FIG. 1. The left and right outer side walls of the support frame 48 are each installed with a picatinny rail 47 for installing sights or other auxiliary appliances to achieve functions extension.

Figure 6:
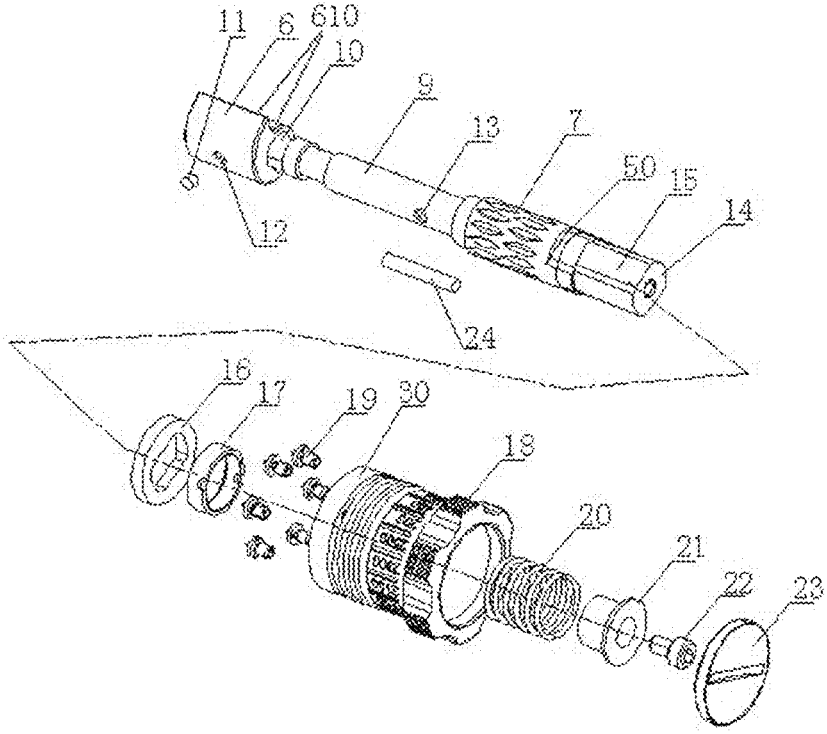
FIG. 6 is a disassembled schematic diagram of the rear angle adjustment assembly.
Figure 7:
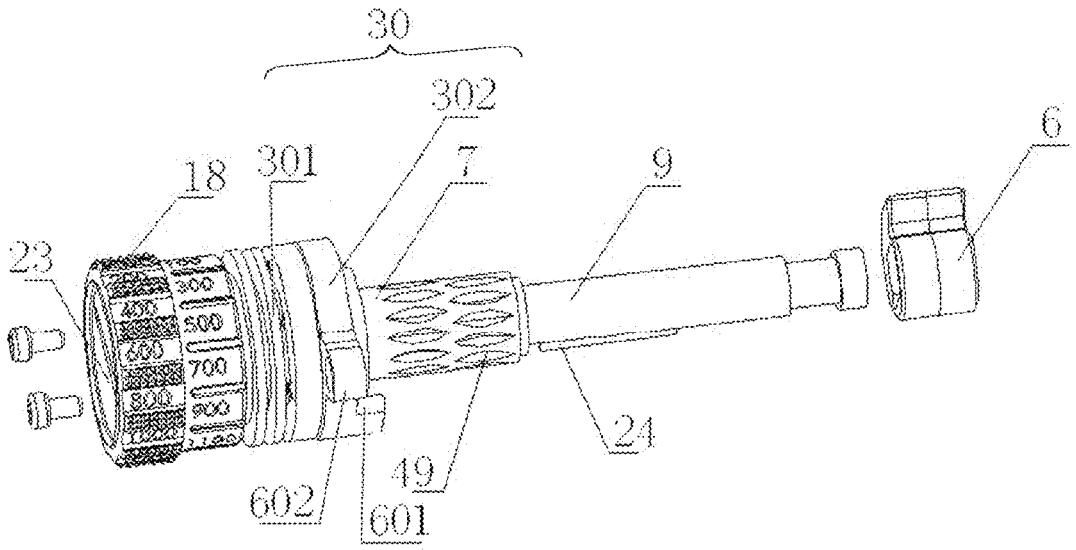
FIG. 7 is an overall view of the rear angle adjustment assembly.
Figure 8:
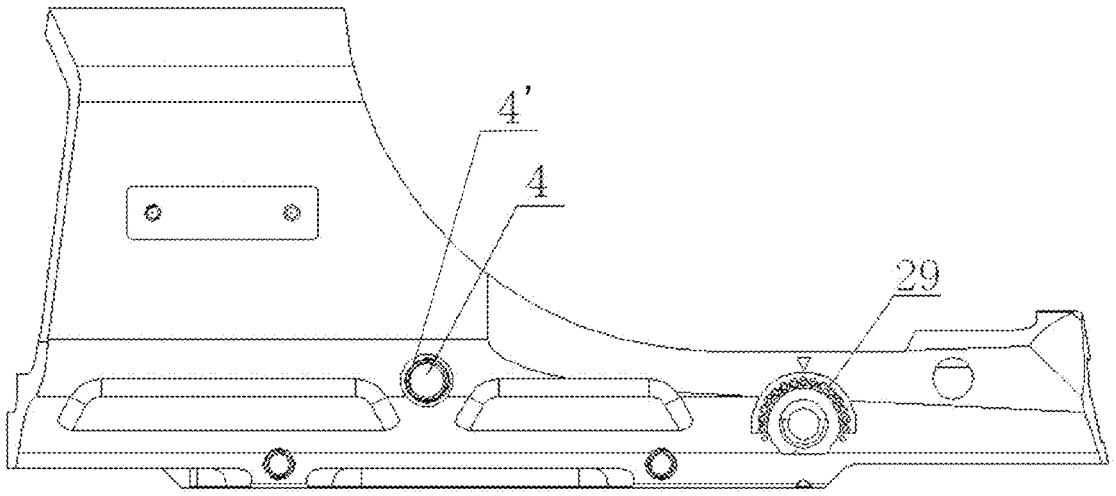
FIG. 8 is a schematic diagram of the side limiting holes of an open airborne or vehicle-mounted sight.
Figure 9:
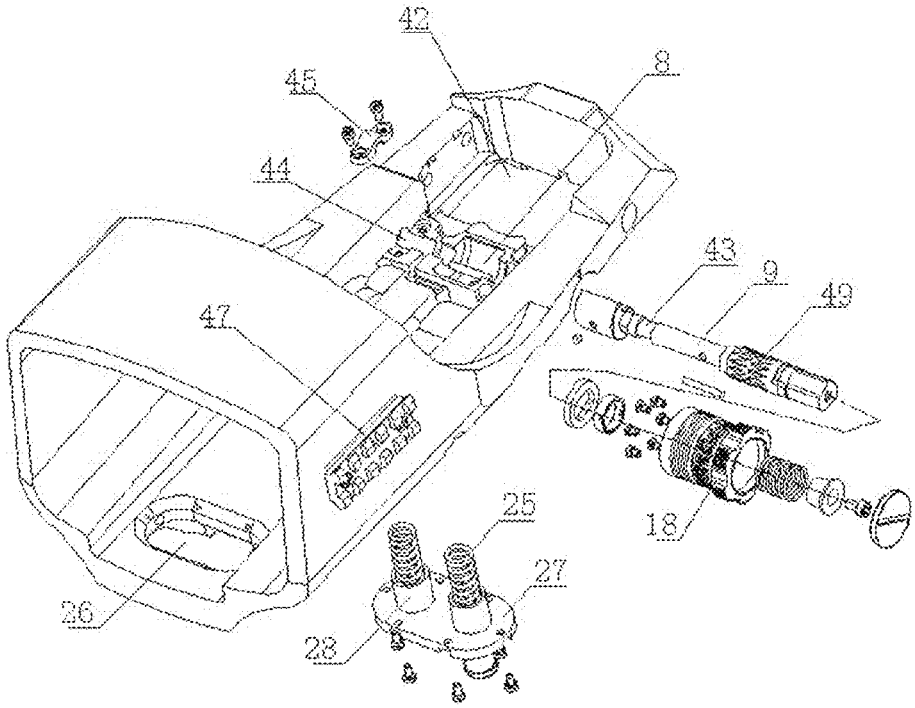
FIG. 9 is a disassembled schematic diagram of the partial construction of the carrier.
Figure 10:
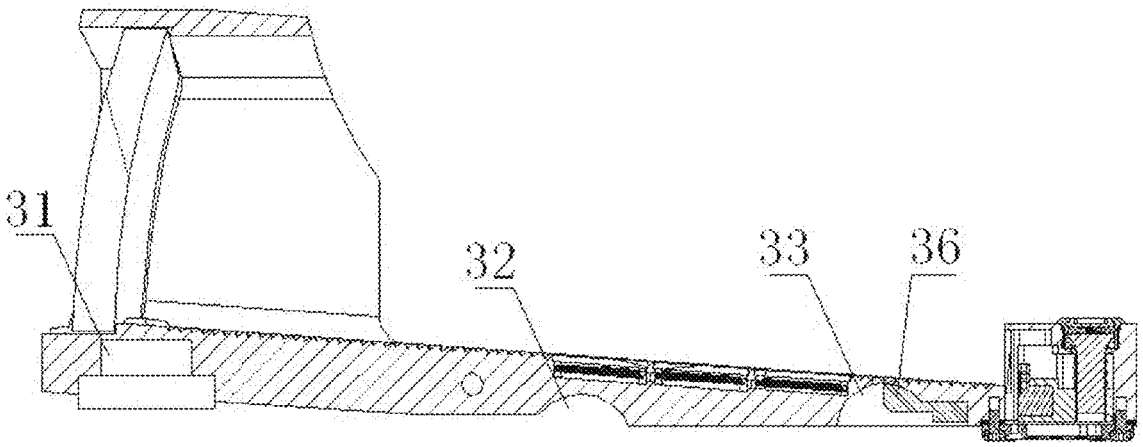
FIG. 10 is an axial cross-sectional view of the inner red dot module carrier.
Figure 11:
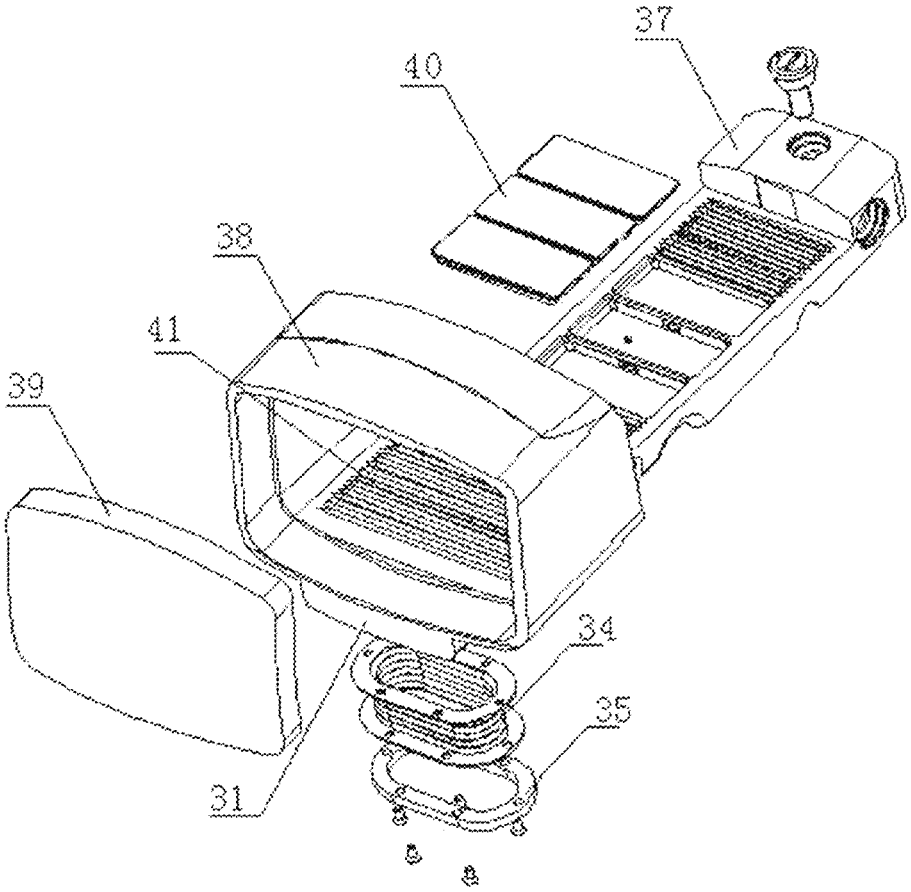
FIG. 11 is a structural disassembly diagram of the inner red dot module carrier.

This embodiment is mainly about the pitch angle adjustment mechanism for expansion description, for details, refer to FIGS. 4 to 11, the pitch angle adjustment mechanism includes a front supporting assembly 3, a fulcrum member, and a rear angle adjustment assembly 5, thereby forming a lever effect with the fulcrum member as the fulcrum. Where, as shown in FIG. 9, the front supporting assembly 3 includes at least a return spring 25 to cooperate with the rear angle adjustment assembly 5 to use the fulcrum member as the pivot point to realize the angle adjustment of the inner red dot module carrier 2, that is, the adjustment of the pitch angle. The angle of the emitted light of the inner red dot module 37 at the end of the inner red dot module carrier 2 is adjusted to complete the adjustment of the ballistic assisted shooting. Where, as shown in FIG. 8, the fulcrum member may be a shaft that passes transversely through the shaft hole 4' on the inner red dot module carrier 2. The two ends of the shaft respectively penetrate the left and right side walls of the carrier 1, that is, the shaft passes through the carrier 1 and the inner red dot module carrier 2 transversely. It is also possible to install ball sleeves on the left and right side walls of the carrier 1, which mainly connects the side walls of the carrier 1 and the corresponding side walls of the inner red dot module carrier 2, and has the function of a bearing, which can ensure that use the ball sleeves on the left and right side walls as the fulcrum to complete the pitch angle rotation adjustment. The front end of the inner red dot module carrier 2 is mounted with a lens 39 through the lens mounting frame 38 as shown in FIG. 11, and is used in conjunction with the inner red dot module 37.

In order to save battery power, the top surface of the inner red dot module carrier 2 provided in this embodiment is provided with a solar electric panel assembly 40, and at the front and back of the solar electric panel assembly 40, a plurality of lateral fillets 41 are engraved on the top surface of the inner red dot module carrier 2 to eliminate the adverse effects of ambient stray light. It can be seen from FIG. 9 that the rear end of the top surface of the carrier 1 is provided with an inner red dot module mounting cavity 42 placed on the rear side of the cam mounting cavity 8.

Figure 4:
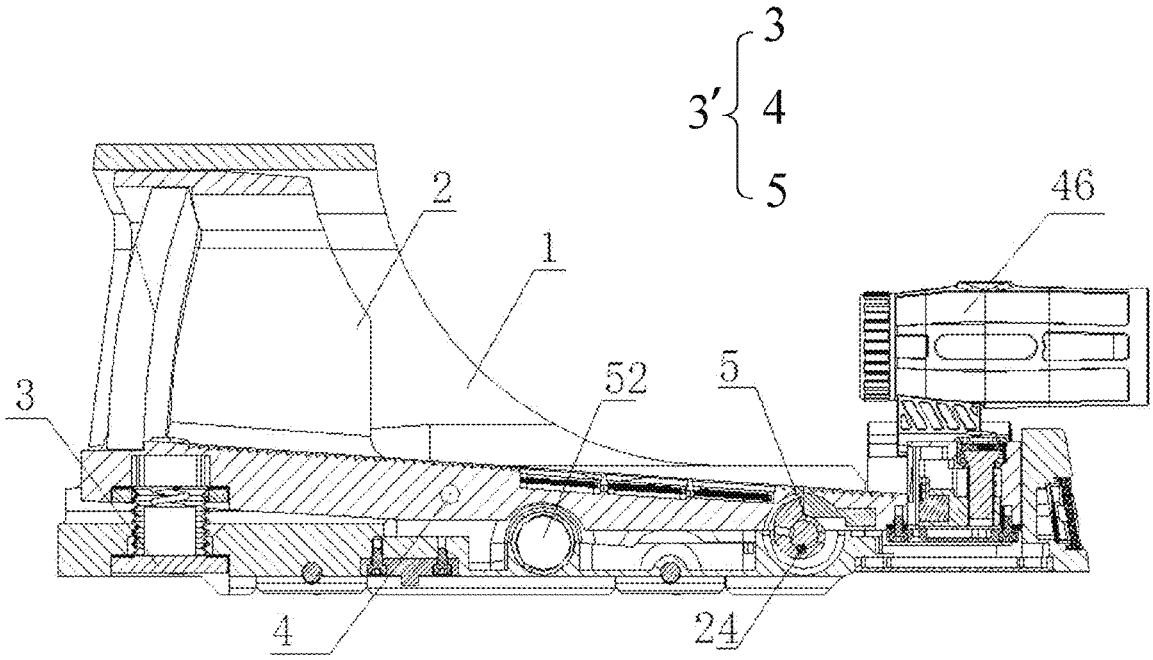
FIG. 4 is an axial cross-sectional view of an open airborne or vehicle-mounted sight.
Figure 5:
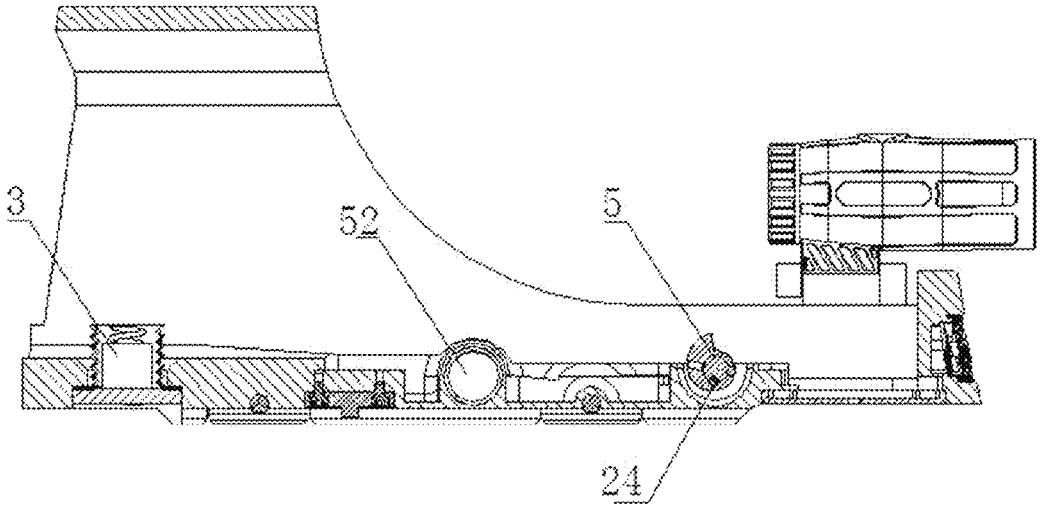
FIG. 5 is an axial cross-sectional view of the carrier.

It can be seen from FIGS. 4 and 5 that the fulcrum member 4 provided in this embodiment consists of arc-shaped ribs provided on the carrier 1, so as to be used in conjunction with the fulcrum matching arc surface 32 provided on the bottom surface of the inner red dot module carrier 2 shown in FIG. 10.

The rear angle adjustment assembly 5 is shown in FIG. 6, at least including an angle adjustment cam 6 and an adjustment operating lever 7; the angle adjustment cam 6 is installed in the cam mounting cavity 8 at the rear end of the top surface of the carrier 1; after the cam mounting end 9 of the adjustment operating lever 7 is inserted into the cam mounting cavity 8 from the outside of a longitudinal side wall of the cam mounting cavity 8 inward, it is inserted into the mounting shaft hole 10 of the angle adjustment cam 6; a positioning knock pin 11 is inserted into the cam limiting hole 12 formed on the circumferential wall of the angle adjustment cam 6 and then extends into the limiting hole 13 formed on the circumferential wall of the cam mounting end 9 to realize the fixing of the angle adjustment cam 6.

Figure 13:
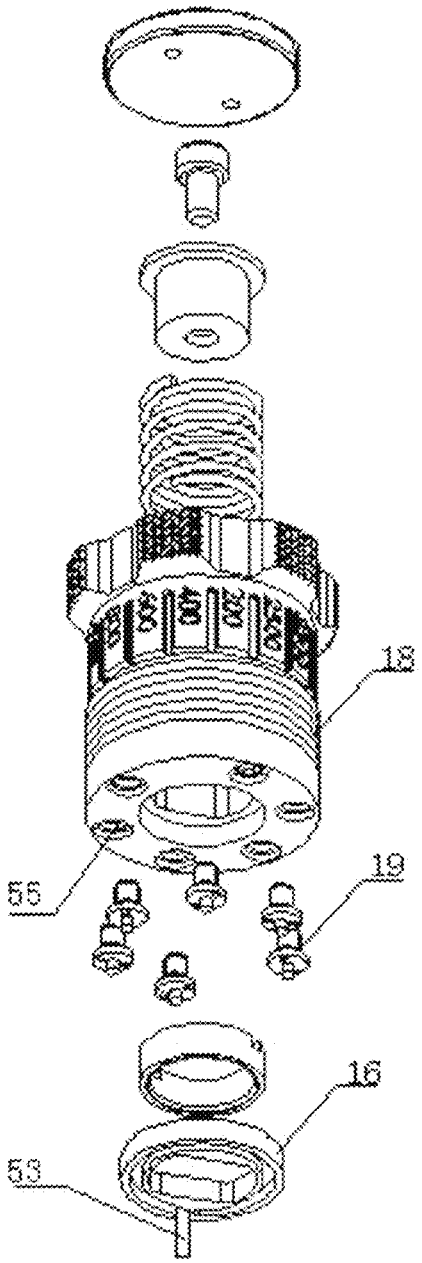
FIG. 13 is a disassembled view of the rear angle adjustment assembly when it is placed vertically.

It can be clearly seen from FIG. 9, where the end of the adjustment operating lever 7 placed outside the cam mounting cavity 8 is the operating end 14 (shown in conjunction with FIG. 6), the end portion of the operating end 14 has at least a pair of opposite planes 15; and the circumferential side wall of the operating end 14 is provided with a pair of shoulders 50 at the innermost end of the opposite planes 15. A positioning ring 16 with an inner hole that matches the end of the operating end 14 is sleeved on the end of the operating end 14 and the inner side of the positioning ring 16 abuts on the shoulders 50; a handwheel retaining ring 17 is threadedly connected to the outer end of the positioning ring 16 to achieve a fixed limit on the positioning ring 16; an tubular adjustment handwheel 18 is sleeved on the operating end, the positioning ring 16 and the hand wheel retaining ring 17, and the inner side of the cavity of the tubular adjustment handwheel 18 has the same cross-section as the positioning ring 16, so as to be locked on the opposite planes 15. A plurality of positioning pins 19 arranged in the circumferential direction are arranged on the end surface of the inner end of the tubular adjustment handwheel 18 to cooperate with the plurality of positioning pin limiting hole 29 circumferentially arranged on the outer wall of the cam mounting cavity 8 to realize the circumferential limit of the tubular adjustment handwheel 18, specifically through the positioning pin mounting holes 55 on the bottom surface of the tubular adjustment handwheel 18 as shown in FIG. 13, the positioning pin mounting hole 55 is generally a screw hole, which is screwed with the positioning pin 19. The cross section of the outside of cavity of the tubular adjustment handwheel 18 is circular, and a handwheel spiral spring 20 is placed in the circular cavity and sleeved on the end of the operating end 14; the hollow cylindrical portion of a handwheel limiting sleeve 21 is inserted into the inner hole of the handwheel spiral spring 20, and the ring flange of the handwheel limiting sleeve 21 touches the outer diameter edge of the handwheel spial spring 20. As shown in FIGS. 6 and 13, the inner diameter of the bottom end portion of the tubular adjustment handwheel 18 where the positioning pin mounting hole 55 is provided is smaller than the inner diameter of the top end of the tubular adjustment handwheel 18. That is, the tubular adjustment handwheel 18 is not formed with the same inner diameter, and the outer diameter of the handwheel spiral spring 20 is greater than the inner diameter of the bottom end of the tubular adjustment handwheel 18, therefore, the handwheel spiral spring 20 can contact the other side of the bottom end of the tubular adjustment handwheel 18 after assembly; and the diameter of the ring flange is greater than the inner diameter of the bottom end portion of the tubular adjustment handwheel 18; a handwheel connecting screw 22 is threadedly connected to the screw hole on the end surface of the end portion of the operating end after passing through the hollow cylinder, and the outer end surface of the tubular adjustment handwheel 18 is threadedly connected with a handwheel block cover 23, which has a protective effect.

Through the combination of the above-mentioned components, it is realized that the rotation of the angle adjustment cam 6 can be realized by rotating the tublar adjustment handwheel 18.

In order to ensure the reliable rotation of the angle adjustment cam 6, a limiting pin 24 extending axially along the angle adjustment cam 6 is arranged between the angle adjustment cam 6 and the cam mounting end 9 in this embodiment to limit the rotation angle range of the angle adjustment cam 6, that is, prevent the angle adjustment cam 6 from continuing to rotate beyond the angle at which the limiting pin 24 is located.

At the same time, in order to avoid accidentally touching the tubular adjustment handwheel 18 and causing rotation, this embodiment further includes a limiting assembly member 30 shown in FIGS. 7 and 8 on the basis of the foregoing embodiment. The limiting assembly member 30 consists of a threaded pipe section 301 and an extended arc portion 302 provided on the outer side wall of the end portion of the threaded pipe section 301, and the positioning pin limiting hole 29 mentioned in the foregoing embodiment is opened on the extended arc portion 302. In this way, the tubular adjustment handwheel 18 is pushed by the handwheel spiral spring 20 to keep the positioning pin 19 always inserted into the positioning pin limiting hole 29, so as to effectively prevent the tubular adjustment handwheel 18 from rotating when touched by external forces, only when the external force pulls the tubular adjustment handwheel 18 outwards in the axial direction until the positioning pin 19 is pulled out from the positioning pin limiting hole 29, the rotation of the tubular adjustment handwheel 18 can be realized, thereby realizing the rotation of the angle adjustment cam 6, when the highest point of the angle adjustment cam 6 touches the bottom surface of the rear end of the inner red dot module carrier 2, the rear end of the inner red dot module carrier 2 is lifted, thereby rotating around the fulcrum member 4 to realize the adjustment of the pitch angle of the inner red dot module carrier 2, and then complete the adjustment of the shooting angle of the inner red dot module, thereby changing the shooting trajectory, correspondingly, a shooting table (dial) is engraved on the outer surface of the tubular adjustment handwheel 18, which is convenient for precise operation.

Figure 15:
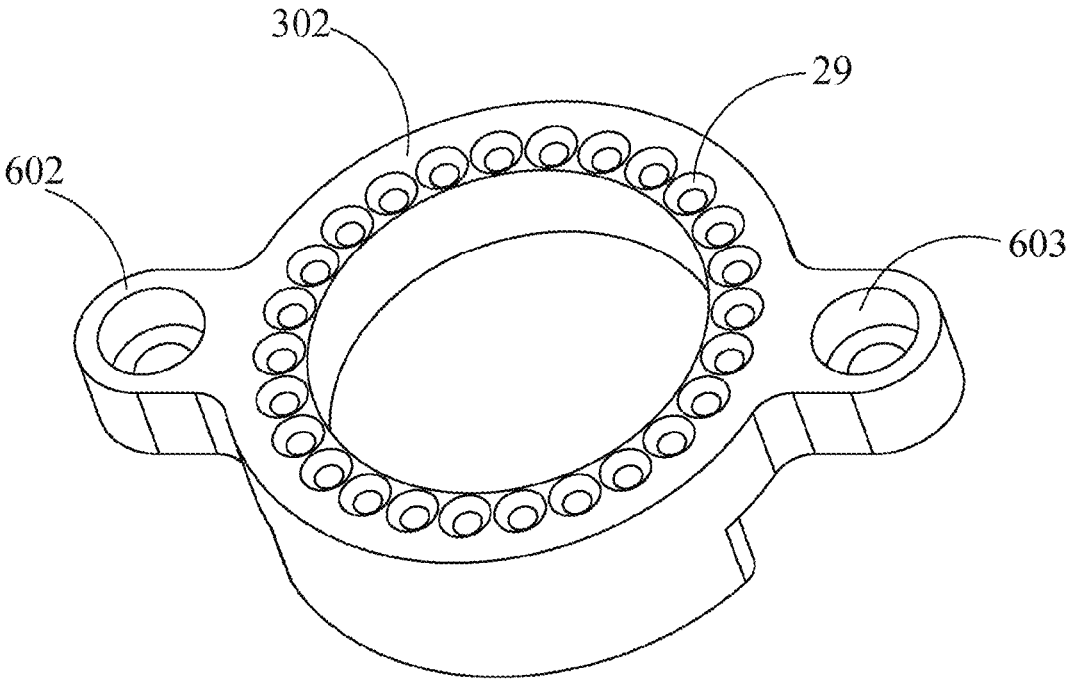
FIG. 15 is a front perspective view of the extended arc portion.
Figure 16:
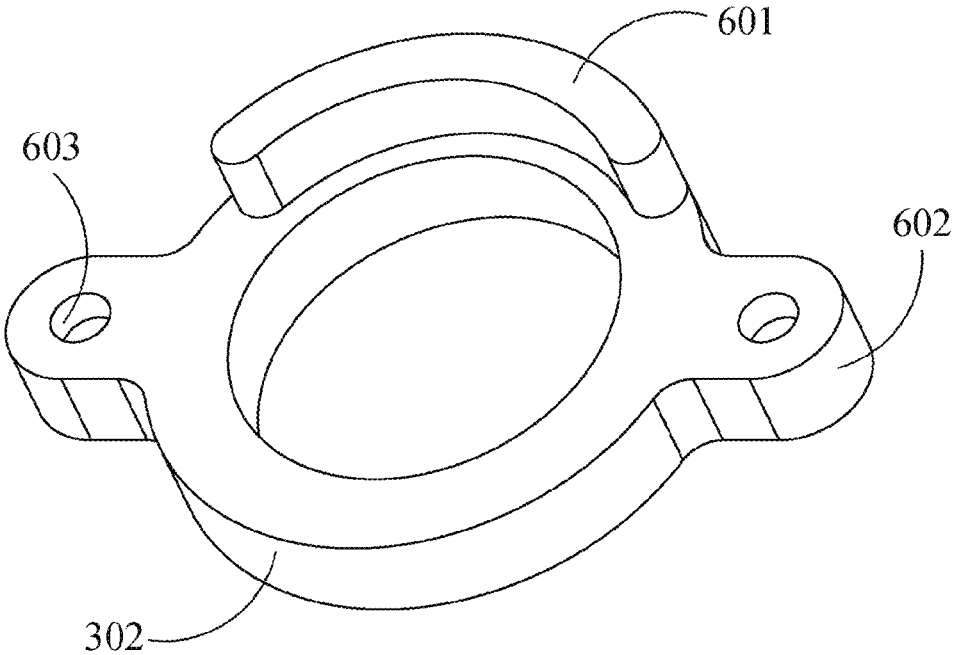
FIG. 16 is a back perspective view of the extended arc portion.

As shown in FIGS. 7, 15 and 16, in this embodiment, the extended arc portion 302 is sleeved on the adjustment operating lever 7 and is in contact with the surface of one end of the threaded pipe section 301 of the limiting assembly member 30. A plurality of positioning pins 19 arranged at the same interval along the circumferential direction are formed on one surface of the threaded pipe section 301 (please refer to FIG. 13). A plurality of positioning pin limiting holes 29 are also formed on the surface of one end of the extended arc portion 302 that is in contact with the threaded pipe section 301. The plurality of positioning pin limiting holes 29 and the setting positions of the plurality of positioning pins 19 correspond to each other. As a result, the positioning pins 19 enter the positioning pin limiting holes 29 under the action of the elastic force of the handwheel spiral spring 20, so that positioning can be achieved.

As shown in FIGS. 7 and 16, a semi-arc protrusion 601 that protrudes toward the outside is formed on the lower part of the other surface of the extended arc portion 302. Two flange portions 602 are provided on the outer peripheral surface of the extended arc portion 302. The two flange portions 602 are formed symmetrically on the circumference, and each flange portion 602 is provided with a through holes 603. When installing the extended arc portion 302 on the outer wall of the cam mounting cavity 8, the extended arc portion 302 is fixedly mounted on the side surface of the outer wall of the cam mounting cavity 8 by using fastening members such as screws. In addition, a semi-circular protrusion that protrudes outward is formed on the upper part of the outer wall of the cam mounting cavity 8. The semi-arc protrusion 601 at the lower part of the extended arc portion 302 is combined with the semi-circular protrusion at the upper part of the cam mounting cavity 8 to form the same plane, therefore, it is possible to further prevent the extended arc portion 302 from rotating along the circumferential direction of the adjustment operating lever 7. Both the semi-arc protrusion 601 and the semi-circular protrusion can be formed in a semi-circular shape, so that when the two are contact each other, they can form a circle. As another example of the semi-arc protrusion 601, FIG. 16 shows that the semi-arc protrusion 601 is formed in a one-third arc shape.

Figure 14:
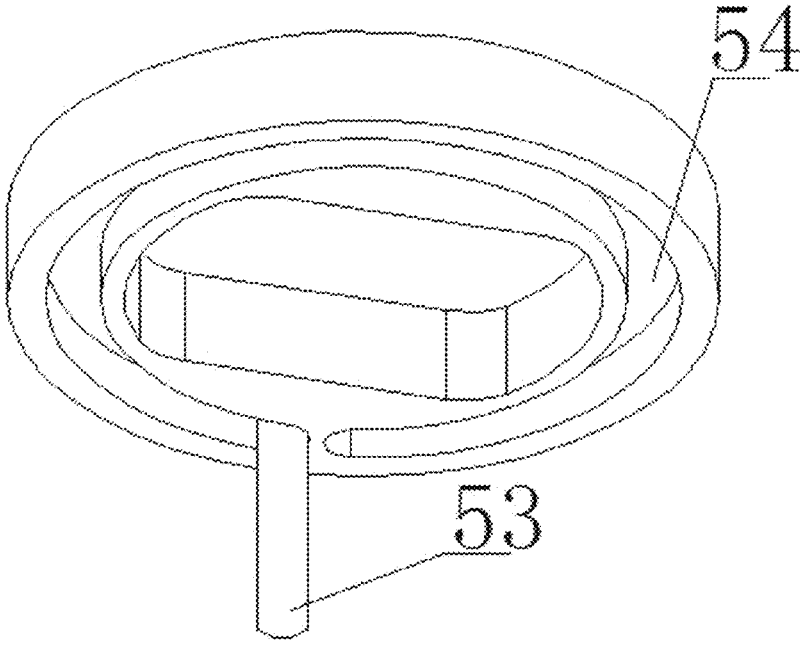
FIG. 14 is a schematic diagram of the coordination between the positioning ring and the limiting pin.

In order to prevent the tubular adjustment handwheel 18 from exceeding the rotation angle of 360 degrees, in this embodiment, a limiting knob 53 as shown in FIG. 8 and FIG. 13 is provided on the outer ring of the limiting assembly member 30 for insertion in the circumferential limiting groove 54, as shown in FIG. 14, on the bottom surface of the positioning ring 16, so as to limit the rotation angle of the positioning ring 16, thereby effectively limiting the rotation angle range of the tubular adjustment handwheel 18.

It can be seen from FIG. 9 that the tail end of the cam mounting end 9 is a constriction 43 for engaging in the limiting groove 44 on the corresponding side of the cam mounting cavity 8 (specifically, the end away from the tubular adjustment handwheel 18), and is fixed in the limiting groove 44 through screws screwing an arc positioning sleeve 45 with ear holes on both sides, which realizes the fixation of the cam mounting end 9 more stably and ensures the balance and stability of operation.

It can be seen from the FIG. 10, the bottom surface of the inner red dot module carrier 2 is provided with mounting blind holes 31, a battery compartment matching arc surface 32 and a cam arc cavity 33 from the front to the back and respectively cooperate with the front supporting assembly 3, the battery compartment 52, and the cam mounting cavity 8, in this way, the matching installation of the inner red dot module carrier 2 and the carrier 1 can be realized.

It can be seen from FIG. 9 that the front supporting assembly 3 further includes a mounting hole 26 opened at the front end of the top surface of the carrier 1 and a front cover plate 27 detachably connected to the mounting hole 26; there are two return springs 25 mentioned above, and the lower ends of the two return springs 25 are inserted side by side into the two guiding and limiting canisters 28 arranged on the top surface of the front cover plate 27 and higher than the top surface of the carrier 1.

As shown in FIG. 11, a drit-proof boot 34 matched with the front supporting assembly 3 is provided, the upper end of the drit-proof 34 is screwed to the mounting blind hole 31 of the front supporting assembly, and the lower end of the drit-proof boot 34 is connected to the front fixing ring 35. The front fixing ring 35 is detachably connected with the front cover plate 27, specifically by screw connection.

The return spring 25 and the guiding and limiting canister 28 are all sleeved in the drit-proof boot 34, and the return spring 25 abuts on the top wall of the mounting blind hole 31 of the front supporting assembly. In this way, the pitch angle of the inner red dot module carrier 2 can be adjusted under the action of the angle adjustment cam 6, that is, when the highest point of the angle adjustment cam 6 is rising, the rear end of the inner red dot module carrier 2 is lifted up, and when the highest point of the angle adjustment cam 6 is lowered, the front end of the inner red dot module carrier 2 is lifted under the action of the return spring 25 to complete the adjustment of the pitch angle of the inner red dot module carrier 2.

Figure 12:
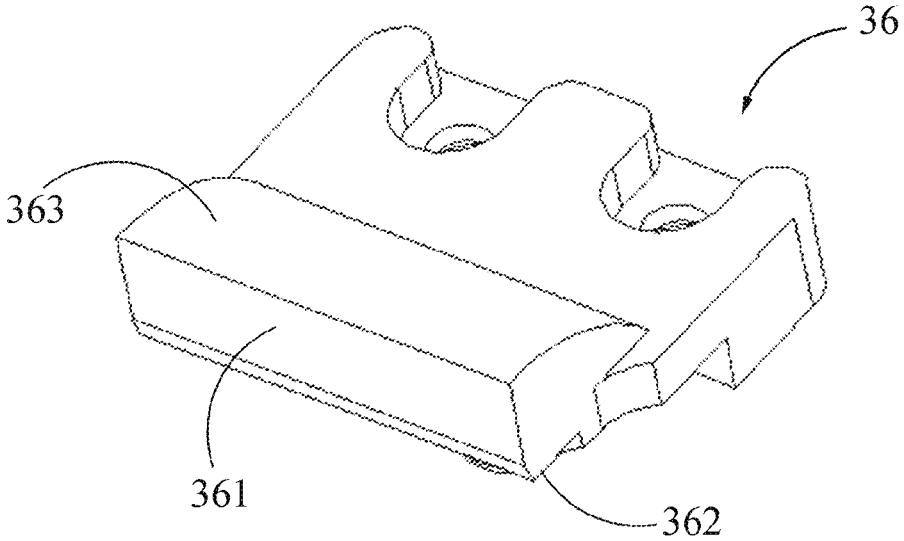
FIG. 12 is a structural diagram of the abutting block.

It can be seen from FIG. 8 and FIG. 10 that the back side of the cam arc cavity 33 is provided with an abutting block 36 shown in FIG. 12 to abut against the contact surface 610 of the angle adjusting cam 6 when the angle adjusting cam 6 rotates. The contact surface 610 is lower than that of the cam, which can stabilize the rotation of the cam, reduce the friction caused by shaking, and prolong the service life.

It can be clearly seen from FIG. 12 that the abutting block 36 mainly includes an arc-shaped end portion at the front end, and the front and bottom surfaces of the arc-shaped end portion are mutually perpendicular planes, namely a vertical surface 361 and a horizontal plane 362, and the arc shape plane 363 connects the vertical plane 361 and the horizontal plane 362, the horizontal portion of the abutting block 36 is placed at the rear end of the arc-shaped end portion, and is mainly used to fix the abutting block 36 on the back side of the cam arc cavity 33 by screws.

In order to facilitate gear adjustment, it can be seen in conjunction with FIGS. 7 and 9 that in this embodiment, a plurality of shift groove corresponding to the limiting holes 29 in the circumferential direction are provided on the outer wall of the end of the operating end 14 on the left side of the shoulder 50 to improve the smoothness of the operation of the tubular adjustment hand wheel 18.

In order to ensure the stability of the inner red dot module carrier 2 during the pitch angle adjustment process, in this embodiment, the two symmetrically installed spring eject pins 51 shown in FIGS. 2 and 3 pass through the side walls of the carrier 1 and then abut on the left and right outer walls of the inner red dot module carrier 2 to ensure the stability of the red dot module carrier 2 during the pitch angle adjustment process.

What is claimed is:

1. An open airborne or vehicle-mounted sight, comprising a carrier and an inner red dot module carrier installed on the carrier;

the inner red dot module carrier is installed on a top surface of the carrier through a pitch angle adjustment mechanism, the pitch angle adjustment mechanism comprising:

a front supporting assembly, a fulcrum member and a rear angle adjustment assembly;

the front supporting assembly comprises at least a return spring to cooperate with the rear angle adjustment assembly to use the fulcrum member as a pivot point to realize an angle adjustment of the inner red dot module carrier;

the fulcrum member is a shaft that being passed transversely through a shaft hole on the inner red dot module carrier, two ends of the shaft respectively being penetrated left and right side walls of the carrier; and the rear angle adjustment assembly at least comprises an angle adjustment cam and an adjustment operating lever;

wherein:

the angle adjustment cam is installed in a cam mounting cavity at a rear end of a top surface of the carrier;

a cam mounting end of the adjustment operating lever is inserted into the cam mounting cavity from an outside of a longitudinal side wall of the cam mounting cavity inward and then is inserted into a mounting shaft hole of the angle adjustment cam; and a positioning knock pin is inserted into a cam limiting hole formed on a circumferential wall of the angle adjustment cam and then is configured to extend into a limiting hole formed on a circumferential wall of the cam mounting end to realize a fixing of the angle adjustment cam;

an inner red dot module, comprising an LED light source;

the LED light source comprising a point light source, a peripheral light source surrounding the point light source.

2. The open airborne or vehicle-mounted sight according to claim 1, wherein an end of the adjustment operating lever placed outside the cam mounting cavity is an operating end, an end portion of the operating end is provided with at least a pair of opposite planes; and a circumferential side wall of the operating end is provided with a pair of shoulders at the innermost end of the opposite planes;

a positioning ring with an inner hole that matches an end portion of the operating end is sleeved on the end portion of the operating end and an inner side of the positioning ring is abutted on the shoulders;

a handwheel retaining ring is threadedly connected to an outer end portion of the positioning ring to achieve a fixed limit on the positioning ring;

a tubular adjustment handwheel is sleeved on the end portion of the operating end, the positioning ring and the hand wheel retaining ring, and an inner side of a cavity of the tubular adjustment handwheel is provided with a same cross-section as the positioning ring, so as to be locked on the opposite planes;

a plurality of positioning pins arranged in a circumferential direction are arranged on an end surface of an inner end of the tubular adjustment handwheel to cooperate with a plurality of positioning pin limiting holes circumferentially arranged on an outer wall of the cam mounting cavity to realize a circumferential limit of the tubular adjustment handwheel;

a cross section of an outside of cavity of the tubular adjustment handwheel is circular, and a handwheel spiral spring is placed in the circular cavity of the tubular adjustment handwheel and sleeved on an end portion of the operating end;

a hollow cylindrical portion of a handwheel limiting sleeve is inserted into an inner hole of the handwheel spiral spring, and a ring flange of the handwheel limiting sleeve is configured to touch an outer diameter edge of the handwheel spiral spring, and a diameter of the ring flange is larger than an inner diameter outside the cavity of the tubular adjustment handwheel;

a handwheel connecting screw is threadedly connected to a screw hole on an end surface of an end portion of the operating end after passing through the hollow cylinder.

3. The open airborne or vehicle-mounted sight according to claim 2, wherein a limiting pin extending axially along the angle adjustment cam is arranged between the angle adjustment cam and the cam mounting end to limit a rotation angle range of the angle adjustment cam.

4. The open airborne or vehicle-mounted sight according to claim 2, wherein the rear angle adjustment assembly further comprises a limiting assembly member which is provided with a threaded pipe section and an extended arc portion disposed on an outer side wall of an end portion of the threaded pipe section, and the positioning pin limiting hole is opened on the extended arc portion.

5. The open airborne or vehicle-mounted sight according to claim 4, wherein a limiting knob is provided on an outer ring of the limiting assembly member for insertion in a circumferential limiting groove on a bottom surface of the positioning ring, so as to limit the rotation angle of the positioning ring.

6. The open airborne or vehicle-mounted sight according to claim 1, wherein the front supporting assembly further comprises a mounting hole opened at a front end of a top surface of the carrier and a front cover plate detachably connected to the mounting hole;

there are two return springs, and lower ends of the two return springs are inserted side by side into two guiding and limiting canisters arranged on a top surface of the front cover plate and higher than the top surface of the carrier.

7. The open airborne or vehicle-mounted sight according to claim 1, wherein a bottom surface of the inner red dot module carrier is provided with mounting blind holes, a battery compartment matching arc surface and a cam arc cavity from front to back and respectively cooperate with the front supporting assembly, a battery compartment, and the cam mounting cavity;

the front supporting assembly further comprises a mounting hole opened at a front end of the top surface of the carrier and a front cover plate detachably connected to the mounting hole;

there are two return springs, and lower ends of the two return springs are inserted side by side into two guiding and limiting canisters arranged on a top surface of the front cover plate and higher than the top surface of the carrier;

an upper end of a drit-proof boot is screwed to the mounting blind hole of the front supporting assembly, and a lower end of the drit-proof boot is connected to a front fixing ring, the front fixing ring is detachably connected with the front cover plate;

the return springs and a guiding and limiting canister are all sleeved in the drit-proof boot, and the return springs abut on a top wall of the mounting blind hole of the front supporting assembly.

8. The open airborne or vehicle-mounted sight according to claim 1, wherein a tail end of the inner red dot module carrier is provided with an inner red dot module, a front end of the inner red dot module carrier is mounted with a lens through a lens mounting frame;

a top surface of the inner red dot module carrier is provided with a solar electric panel assembly, and at a front and back of the solar electric panel assembly, a plurality of lateral fillets are engraved on the top surface of the inner red dot module carrier to eliminate the adverse effects of ambient stray light;

a rear end of the top surface of the carrier is provided with an inner red dot module mounting cavity placed on a rear side of the cam mounting cavity.

9. The open airborne or vehicle-mounted sight according to claim 1, wherein a tail end of the cam mounting end is a constriction for engaging in a limiting groove on a corresponding side of the cam mounting cavity, and is fixed in the limiting groove through screws screwing an arc positioning sleeve with ear holes on both sides;

a magnifier is provided on a side of a tail end of the carrier.

10. The open airborne or vehicle-mounted sight according to claim 1, wherein the front supporting assembly further comprises a mounting hole opened at a front end of a top surface of the carrier and a front cover plate detachably connected to the mounting hole;

there are two return springs, and lower ends of the two return springs are inserted side by side into two guiding and limiting canisters arranged on a top surface of the front cover plate and higher than the top surface of the carrier.

11. The open airborne or vehicle-mounted sight according to claim 2, wherein the front supporting assembly further comprises a mounting hole opened at a front end of a top surface of the carrier and a front cover plate detachably connected to the mounting hole;

there are two return springs, and lower ends of the two return springs are inserted side by side into two guiding and limiting canisters arranged on a top surface of the front cover plate and higher than the top surface of the carrier.

12. The open airborne or vehicle-mounted sight according to claim 3, wherein the front supporting assembly further comprises a mounting hole opened at a front end of a top surface of the carrier and a front cover plate detachably connected to the mounting hole;

there are two return springs, and lower ends of the two return springs are inserted side by side into two guiding and limiting canisters arranged on a top surface of the front cover plate and higher than the top surface of the carrier.

13. The open airborne or vehicle-mounted sight according to claim 4, wherein the front supporting assembly further comprises a mounting hole opened at a front end of a top surface of the carrier and a front cover plate detachably connected to the mounting hole;

there are two return springs, and lower ends of the two return springs are inserted side by side into two guiding and limiting canisters arranged on a top surface of the front cover plate and higher than the top surface of the carrier.

14. The open airborne or vehicle-mounted sight according to claim 5, wherein the front supporting assembly further comprises a mounting hole opened at a front end of a top surface of the carrier and a front cover plate detachably connected to the mounting hole;

there are two return springs, and lower ends of the two return springs are inserted side by side into two guiding and limiting canisters arranged on a top surface of the front cover plate and higher than the top surface of the carrier.

* * * * *